US010253578B2

(12) United States Patent
Eppink et al.

(10) Patent No.: US 10,253,578 B2
(45) Date of Patent: Apr. 9, 2019

(54) DRILL MOTOR CONNECTING ROD

(71) Applicant: Smith International, Inc., Houston, TX (US)

(72) Inventors: Jay Milton Eppink, Spring, TX (US); Thomas James Fields, Katy, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 200 days.

(21) Appl. No.: 14/776,631

(22) PCT Filed: Mar. 14, 2014

(86) PCT No.: PCT/US2014/028586

§ 371 (c)(1),
(2) Date: Sep. 14, 2015

(87) PCT Pub. No.: WO2014/144256

PCT Pub. Date: Sep. 18, 2014

(65) Prior Publication Data

US 2016/0040486 A1 Feb. 11, 2016

Related U.S. Application Data

(60) Provisional application No. 61/793,363, filed on Mar. 15, 2013.

(51) Int. Cl.
*E21B 17/20* (2006.01)
*E21B 4/02* (2006.01)
(Continued)

(52) U.S. Cl.
CPC ..... *E21B 17/20* (2013.01); *E21B 3/00* (2013.01); *E21B 4/02* (2013.01); *E21B 7/04* (2013.01)

(58) Field of Classification Search
CPC ... E21B 17/20; E21B 4/02; E21B 7/04; E21B 3/00
See application file for complete search history.

(56) References Cited

U.S. PATENT DOCUMENTS 3,879,094 A * 4/1975 Tschirky ..... E21B 4/003 384/420
4,141,225 A * 2/1979 Varner ..... E21B 17/05 175/57

(Continued)

FOREIGN PATENT DOCUMENTS

GB 190305549 A * 5/1903
WO 2014144256 A1 9/2014

OTHER PUBLICATIONS

International Search Report for International Application No. PCT/US2014/028586 dated Jul. 24, 2014.

*Primary Examiner* — James G Sayre

(57) ABSTRACT

A downhole motor may include a power section, a connecting rod assembly, and a drive shaft. The power section may include a stator and a rotor with the rotor configured to rotate eccentrically when a drilling fluid is passed through the stator. The connecting rod assembly operatively connects the rotor of the power section and the drive shaft of the bearing section. The connecting rod assembly may include a housing and a connecting rod. The housing may have a proximal end and a distal end with the proximal end connected to the stator. The connecting rod may include a proximal end including a rigid connection operatively connected to the rotor, a mid flexible rod, and a distal end terminating at or proximate an articulating joint. The drive shaft may be operatively connected to the articulating joint.

21 Claims, 4 Drawing Sheets

(51) Int. Cl.
*E21B 7/04* (2006.01)
*E21B 3/00* (2006.01)

(56) References Cited

U.S. PATENT DOCUMENTS

| | | | | |
|---|---|---|---|---|
| 4,636,151 | A | 1/1987 | Eppink | |
| 4,679,638 | A * | 7/1987 | Eppink | E21B 4/02 175/107 |
| 4,772,246 | A | 9/1988 | Wenzel | |
| 4,982,801 | A | 1/1991 | Zitka et al. | |
| 5,090,497 | A * | 2/1992 | Beimgraben | F04C 15/0076 175/107 |
| 5,135,059 | A * | 8/1992 | Turner | E21B 4/02 175/101 |
| 5,267,905 | A | 12/1993 | Wenzel et al. | |
| 5,288,271 | A | 2/1994 | Nelson et al. | |
| 6,949,025 | B1 | 9/2005 | Kraus et al. | |
| 2009/0275415 | A1 | 11/2009 | Prill et al. | |
| 2011/0005839 | A1 | 1/2011 | Marchand et al. | |
| 2011/0147091 | A1 | 6/2011 | Bullin | |
| 2013/0020132 | A1* | 1/2013 | John | E21B 4/02 175/57 |
| 2016/0130878 | A1* | 5/2016 | Cobern | E21B 7/04 175/25 |

* cited by examiner

DRILL MOTOR CONNECTING ROD

BACKGROUND

Downhole mud motors have been employed extensively in the drilling of wells, boreholes and other subterranean bores. One type of hydraulic downhole mud motor is the progressive cavity motor (or pump), which is also known as a Moineau motor (or pump). The progressive cavity downhole mud motor includes a power section that has a stator and a rotor disposed within the stator. The rotor rotates and gyrates in response to fluid (e.g., drilling fluid or drilling mud) pumped downhole and through the stator. A drive shaft is located within a bearing housing with the bearing housing being connected to the stator via a cross-over housing rigidly attached between them. A connecting rod extends between the rotor and the drive shaft for translating the rotation and gyration of the rotor to the true rotation of the shaft. The connecting rod may have an upset section on each end. Upper and lower connections connect the upset sections of the connecting rod to the rotor and to the drive shaft.

There are generally three types of connecting rods currently used in the industry. The first two types are similar and use two sets of articulating joints, one at each end of the connecting rod. The first of such type is generally known as a lobe coupling with surfaces between the upper and lower ends of the joint loading against two or more slotted surfaces that are cut radially to the center of the parts. Also, each upper and lower joint is loaded compressively along their longitudinal axis through a ball bearing or spherical surface against their respective spherical surfaces.

The second of such type using two sets of articulating joints is generally known as a universal joint or constant velocity joint. This joint consists of an internal and an external housing. The outside of the internal housing having spherical indentions that house several ball bearings, the external housing having radiused slots that ride over the outer half of each ball bearing. Again, each upper and lower joint is loaded compressively along their longitudinal axis through a ball bearing or spherical surface against their respective spherical surfaces. The articulated joints can be sealed from the circulating drilling mud using boots, O-rings or lip seals.

The third type of connecting rod is a flexible rod that is connected to both the rotor and drive shaft with rigidly attached connections normally of the rotary shouldered connection type.

Downhole mud motors have a cross-over housing connecting the stator to the bearing housing that locates the drive shaft relative to the stator. Motors of the steerable type have a bend or bends between the stator and bearing housing normally formed in the cross-over housing. The bend makes the bit offset to and at an angle from the center of the motor and bottom hole assembly (BHA) above. The steerable motor can drill straight ahead when the motor and BHA are rotated while fluid is pumped through the motor so that the offset load and bit angle are evenly distributed in all radial directions as the bit drills. Whenever the motor is needed to drill towards a specific direction, the drill string and BHA are stopped from rotating and located circumferentially in the direction desired. The drill string is slid so that the bit offset load and bit angle will cause the bit to drill towards the desired direction. Once the borehole has started in the desired direction the hole curvature is developed.

The size of hole curvature is controlled by the motor setup and BHA. For a more aggressive smaller curvature or faster direction change, the bend angle and offset are increased.

This direction change is called a dogleg and is measured in degrees per hundred feet or per 30 meters. The bend angle is setup on a motor so that when a direction change is required, the borehole will be drilled at a minimum to the dogleg required. The dogleg is normally larger than required so that the borehole needs to be drilled straight for short distances to compensate. Through an extended direction change, the borehole is a series of short high doglegs with straight sections between. The optimum setup is to have as few of these changes as possible. Due to the configuration of the assembly, the motor, BHA and drill string must follow the bit through the curvature in the borehole. The size and geometry of the motor and BHA with respect to the borehole may restrict the passage or create large side loads on the motor and BHA when passing through the borehole. This is especially true as the curvature becomes smaller or changes direction more quickly with respect to distance drilled. It is advantageous to have the bend close to the bit so that there is not an excessive amount of offset at the bit for the amount of bit angle. When a motor is rotated in a curved section of the hole, the bit offset causes a high cyclic bending moment on the motor each time its bend rotates opposite the hole curvature. BHA studies and drilling experience have shown that there is a practical optimum range of bend to bit distance for each size motor for the amount of dogleg capability versus the bend angle. The practical shortest bit to bend distance is at the top of the bearing housing.

Lobe coupling articulated joints tend to wear at the load surfaces and crack at the base of the lobes. Constant velocity articulating joints tend to wear in the external housing slots and crack the ball bearings.

Due to the direction, or angle from centerline of the motor, of the connecting rod center rod, any thrust loads applied by the rotor through the connecting rod create side loads or radial loads at the rotor lower end and the drive shaft through the articulated joint. At the rotor lower end, increased thrust loads, such as from motor stall, cause the side loads to increase, pushing the rotor harder into the stator at the root of the stator lobe and away. The rotor tip is pulled away from the stator tip so that interference or elastomer squeeze in the stator is reduced and consequently the holding pressure and torque capacity is reduced.

A flexible connecting rod needs considerable length to have the torsional strength and diameter required to transfer the power section torque to the drive shaft and still have small enough side loads and bending loads so that the rotor connection, stator rubber and drive shaft connection have the load capacity to hold the loads. Even with a more flexible material for the rod, the lengths may become excessive due to increased power section capacities (in recent years, power sections have been introduced that generate very high torque, including "even-wall" stators such as the ERT series offered by Robbins & Myers, and hard rubber (HR) stators such as those offered by Dyna-Drill, where the higher torque results from the ability of these power sections to withstand higher operating pressures and pressure drops). As a result, connecting rods are required to be larger in diameter to handle the larger torque loads which increase their stiffness and which in turn requires more length to keep the side loads and bending loads from increasing.

Connecting rods with articulated joints on both ends allow the bend to be at or near the lower joint which is attached to the drive shaft. Conversely, the longer rigidly connected flexible rod is not well suited to have the bend at one end, because an already long rod must become larger and longer to overcome the increased bending moment at the lower end. For the flexible connecting rod with rigid connections, the smallest shortest rod has the cross-over housing bend situated half way between its ends. Also, an increase in bend angle creates an increase of the bending moment on such rod so that an even larger diameter and additional length is needed to keep the material stress levels below the endurance limit. Furthermore, this bending moment loads the rotor unevenly to one side in the stator at the lower end with the side load being towards the inside of the bend.

Nevertheless, the increased flexibility of such flexible connecting rod reduces the dynamic torques seen from sudden bit speed changes from hanging up or from slip stick. There is a tradeoff between rod flexibility and addition length of the motor required for that flexibility for both torsion and bending. The flexible rod is rigidly connected at both ends so that due to the offset a double bend is required in the rod and a direction change of the bending moment in the rod towards its center. There must be a side load at each end to create the moment at each end of the rod. For the rod to have the torsional strength required, it must be long enough from each end to reduce the side loads to an acceptable level and still create the bending moments required for the offset.

Connecting rods must be able to transfer the peak torques from the power sections to the bit. The peak torques can be as large as the motor stall torque plus the dynamic torque from bit hang up or slip stick.

The articulated joint at the lower end of the rotor gyrates with the rotor eccentrically about the stator at a rate of the number of rotor lobes times the motor rpm. This can create excessive centrifugal forces on the moving parts of an articulated joint. Also, the available diameter in this area that can be used for an articulating joint is reduced by the rotor sweep through the gyration from the eccentricity between the rotor and stator and the inside diameter of the stator tube or adjoining housing.

Due to more powerful motor torque capacities and diameter limitations, more efficient use of this space is needed. Tool joints have no moving parts with load surfaces that wear during the course of a motor run. They can more effectively transfer higher torque loads over the life of the tool.

However, threaded connections within the drive train also have torque limitations. The threaded connections can fail from their torque capacity being exceeded thereby causing the connection to make up further and yield the connection male and female members until it pulls itself apart or cracks and fails. Even with a tool joint connecting the rotor, there is a need to reduce the peak torque loads.

Various motor connecting rods and additional background information are disclosed in U.S. Pat. Nos. 4,636,151, 4,772,246, 4,982,801, 5,090,497, 5,267,905, 5,288,271, and 6,949,025, among others.

SUMMARY OF THE DISCLOSURE

In one aspect, embodiments disclosed herein relate to a downhole motor, which may include a power section, a connecting rod assembly and a drive shaft. The power section may include a stator and a rotor, with the rotor configured to rotate eccentrically when a drilling fluid is passed through the stator. The connecting rod assembly operatively connects the rotor and the drive shaft. The connecting rod assembly may include a housing and a connecting rod. The housing may have a proximal end and a distal end with the proximal end connected to the stator. The connecting rod may include a proximal end including a rigid connection operatively connected to the rotor, a distal end operatively connecting to an articulating joint, and mid flexible rod section disposed between the proximal end and the distal end of the connecting rod. The drive shaft may be operatively connected to the articulating joint.

In another aspect, embodiments disclosed herein relate to a downhole motor, may include a power section, a connecting rod assembly and a drive shaft. The power section may include a stator and a rotor, with the rotor configured to rotate eccentrically when a drilling fluid is passed through the stator. The connecting rod assembly operatively connects the rotor and the drive shaft. The connecting rod assembly may include a housing and a connecting rod. The housing may have a proximal end and a distal end with the proximal end connected to the stator. The connecting rod may include a flexible rod having an upper pin connection and a lower pin connection with the upper pin connection operatively connected to the rotor and the lower pin connection operatively connected to a first end of an upper member of an articulating joint. A second end of the upper member may cooperate with torque transferring components of the articulating joint. The drive shaft may be operatively connected to the articulating joint.

In another aspect, embodiments disclosed herein relate to a downhole motor, which may include a power section, a connecting rod assembly, and a drive shaft. The power section may include a stator and a rotor, with rotor configured to rotate eccentrically when a drilling fluid is passed through the stator. The connecting rod assembly operatively connects the rotor and the drive shaft. The connecting rod assembly may include a housing and a connecting rod. The housing may have a proximal end and a distal end with the proximal end connected to the stator. The connecting rod may have an upper pin connection operatively connected to the rotor and a mid flexible rod section connected between the upper pin connection and a lower end. The lower end cooperates with torque transferring components of an articulating joint. The drive shaft may be operatively connected to the articulating joint.

In another aspect, embodiments disclosed herein relate to a downhole motor, which may include a power section, a connecting rod assembly, and a drive shaft. The power section may include a stator and a rotor, with the rotor configured to rotate eccentrically when a drilling fluid is passed through the stator. The connecting rod assembly operatively connects the rotor and the drive shaft. The connecting rod assembly may include a housing and a connecting rod. The housing may have a proximal end and a distal end with the proximal end connected to the stator. The connecting rod may have an upper pin connection operatively connected to the rotor and a mid flexible rod section connected between the upper pin connection and an upset section. An articulating joint may have an upper member with one end connected to the upset section. The other end may have torque transferring components cooperating with the articulating joint. The drive shaft may be operatively connected to the articulating joint.

In another aspect, embodiments disclosed herein relate to a downhole motor, which may include a power section, a connecting rod assembly, and a drive shaft. The power section may include a stator and a rotor, with the rotor configured to rotate eccentrically when a drilling fluid is passed through the stator. The connecting rod assembly operatively connects the rotor and the drive shaft. The connecting rod assembly may include a housing and a connecting rod. The housing may have a proximal end and a distal end with the proximal end connected to the stator. The connecting rod may include a flexible rod having an upper rotary shouldered connection and a lower rotary shouldered connection. The upper rotary shouldered connection may operatively connect to the rotor and the lower rotary shouldered connection may operatively connect to a first end of an upper member of an articulating joint. A second end of the upper member may cooperate with torque transferring components of the articulating joint. The drive shaft may be operatively connected to the articulating joint.

In another aspect, embodiments disclosed herein relate to a drill motor connecting rod assembly. The drill motor connecting rod assembly may include a housing having a proximal end and a distal end as well as a connecting rod disposed within the housing. The connecting rod may include a proximal end terminating at a rigid connection, a distal end operatively connecting to an articulating joint, and a mid flexible rod section connected between the proximal and distal ends of the connecting rod.

In another aspect, embodiments disclosed herein relate to a drill motor connecting rod assembly. The drill motor connecting rod assembly may include a housing having a proximal end and a distal end as well as a connecting rod disposed within the housing. The connecting rod may include a flexible rod having an upper pin connection and a lower pin connection. The lower pin connection may be operatively connected to a first end of an upper member of an articulating joint. A second end of the upper member may cooperate with torque transferring components of the articulating joint.

In another aspect, embodiments disclosed herein relate to a drill motor connecting rod assembly. The drill motor connecting rod assembly may include a housing having a proximal end and a distal end as well as a connecting rod disposed within the housing. The connecting rod may have an upper pin connection and a mid flexible rod section connected between the upper pin connection and a distal end. The distal end may have torque transferring components cooperating with an articulating joint.

In another aspect, embodiments disclosed herein relate to a drill motor connecting rod assembly. The drill motor connecting rod assembly may include a housing having a proximal end and a distal end as well as a connecting rod disposed within the housing. The connecting rod may have an upper pin connection and a mid flexible rod section connected between the upper pin connection and an upset section. An articulating joint may have an upper member with one end connected to the upset section and the other end having torque transferring components cooperating with the articulating joint.

In another aspect, embodiments disclosed herein relate to a drill motor connecting rod assembly. The drill motor connecting rod assembly may include a housing having a proximal end and a distal end as well as a connecting rod disposed within the housing. The connecting rod may include a flexible rod having an upper rotary shouldered connection and a lower rotary shouldered connection. The lower rotary shouldered connection may operatively connect to a first end of an upper member of an articulating joint. The second end of the upper member may cooperate with torque transferring components of the articulating joint.

In another aspect, embodiments disclosed herein relate to a downhole motor, which may include a power section, a connecting rod assembly and a drive shaft. The power section may include a stator and a rotor, with the rotor configured to rotate eccentrically when a drilling fluid is passed through the stator. The connecting rod assembly may operatively connect the rotor and the drive shaft. The connecting rod assembly may include a housing having a proximal end and a distal end with the proximal end connected to the stator. The connecting rod assembly may also include a connecting rod having a flexible rod with an upper pin connection and a lower shrink fit connection. The upper pin connection may operatively connect to the rotor and the lower shrink fit connection may operatively connect to an articulating joint.

In another aspect, embodiments disclosed herein relate to a drill motor connecting rod assembly. The connecting rod assembly may include a housing having a proximal end and a distal end as well as a connecting rod disposed within the housing. The connecting rod may include a flexible rod having an upper rotary shouldered connection and a lower end shrunk fit to a first end of an upper member of an articulating joint. A second end of the upper member may cooperate with torque transferring components of the articulating joint.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Figure 1:
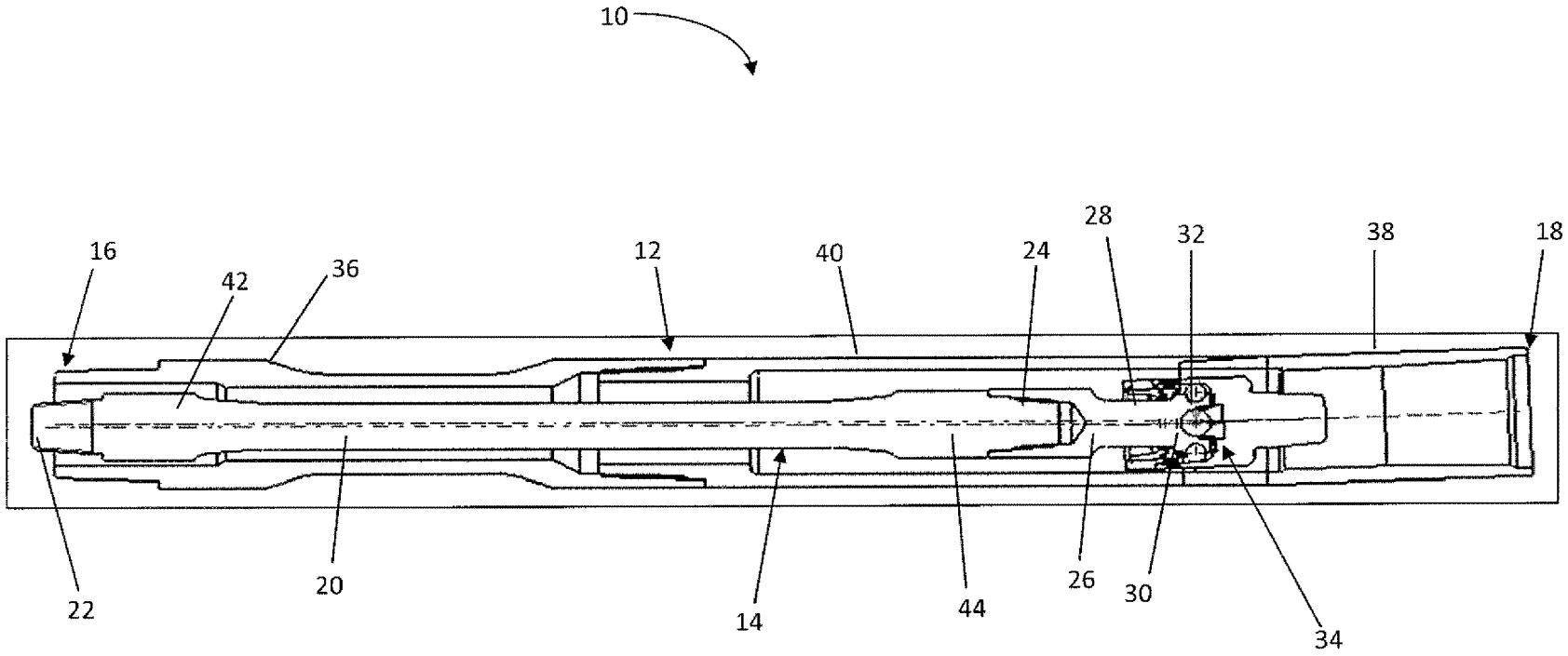
FIG. 1 is a schematic diagram of a connecting rod assembly according to one or more embodiments herein.

A downhole motor, such as Moineau type or progressive cavity type motor, produces and transmits torque to a drive shaft associated with the downhole motor for drilling operations, e.g., for drilling wells, boreholes and other subterranean bores. One or more embodiments disclosed herein relate to connecting rods and connecting rod assemblies for transmitting torque between articulating shafts. Connecting rods and connecting rod assemblies disclosed herein may be useful for transferring relatively high torque and axial thrust loads.

The downhole motors described herein may include a power section, a connecting rod assembly, and a drive shaft. The power section may include a stator and a rotor configured to rotate eccentrically when a drilling fluid or mud is passed through the stator. The connecting rod assembly operatively connects the power section and the drive shaft. The connecting rod assembly may include a housing and a connecting rod. The housing may have a proximal end and a distal end with the proximal end connected to the stator. The connecting rod may include a proximal end including a rigid connection operatively connected to the rotor, a mid flexible rod, and a distal end connecting to an articulating joint. In one or more embodiments, the distal end of the connecting rod connects to the articulating joint through an upper member of the articulating joint. In one or more other embodiments, the mid flexible rod section connects directly to the upper member of the articulating joint such that the mid flexible rod section is the distal end of the connecting rod (or there is no separate distal end of the connecting rod apart from the mid flexible rod section). In one or more other embodiments, the connecting rod may be arranged and designed to operatively connect with the articulating joint (i.e., without connecting through an upper member of the articulating joint). The drive shaft may be operatively connected to the articulating joint.

The rigid connection at the proximal end of the connecting rod may be at least one of a threaded connection, a pin connection, or a rotary shouldered connection. In some embodiments, the rigid connection is a pin connection. In other embodiments, the rigid connection is a rotary shouldered connection.

The connecting rod may also include an upset section intermediate the rigid connection (e.g., pin connection) and the mid flexible rod. The upset section may provide a section of increased diameter, which provides additional strength to the connecting rod proximate the rigid connection, e.g., pin connection.

The articulating joint located at or proximate the distal end of the connecting rod may include a constant velocity joint (CV joint) or a universal joint (U-joint), among others. For example, such articulating joint may include a component, e.g., an upper member, with one end portion being integrally connected or non-integrally connected with the connecting rod and the other end portion cooperating with torque transferring components of the articulating joint. As described above, in one or more embodiments, the connecting rod itself may operatively connect to the articulating joint. The articulating joint may include (and may be operatively connected with the upper member or connecting rod via) two or more drive key sockets, e.g., integrally formed in the upper member or connecting rod, and a cylindrical thrust insert socket, among other torque transferring components. Drive key sockets may be configured to engage drive keys (e.g., ball bearings) disposed within the drive key socket, and together form a torque transferring module having a spherical outer surface. The articulating joint may thus include two or more spherical torque transferring modules, each including a drive key socket and a drive key. The articulating joint may be disposed within a housing such that the torque transferring components are disposed in keyways and a thrust member abuts a concave bearing surface. In operation, the socket section may provide for omni-directional movement between the connecting rod and the housing while transferring axial thrust loads and torque loads across the mating bearing sections of the connecting rod and housing, respectively.

In some embodiments, the proximal end, mid flexible rod section, and distal end of the connecting rod are unitary in construction. The unitary portions of the connecting rod may be made from the same material. Thus, a unitary connecting rod may allow the design complexity of the added stiff length of a connection at each end for a different material to be eliminated.

In some embodiments, the mid flexible rod may be made of a flexible material such as titanium or a titanium-based alloy. The mid flexible rod may have connections at the ends, which may be formed from a different material. Thus, two or more portions of the connecting rod may be made from different materials. Where different materials are used, the connecting rod may include an upset section for weld joint strength.

In one or more embodiments, a connecting rod may include a weld operatively connecting the mid flexible rod section to an upper member (or other component) of the articulating joint. The upper member may also be described as a shaft connecting and extending uphole from the articulating joint. In other embodiments, the connecting rod may include a pin connection operatively connecting the distal end (or the mid flexible rod, if the connecting rod does not include a distal end separate from the mid flexible rod) to an upper member of the articulating joint. In other embodiments, the mid flexible rod or distal end of the connecting rod may include a rotary shouldered connection operatively connecting the connecting rod and the upper member of the articulating joint.

The housing of the downhole motor may be tailored based on the combination of rigid connection and articulated joint connection selected. In some embodiments, the housing may include a proximal flex housing section, a distal bearing housing section, and a cross-over housing section therebetween. The cross-over housing may include a bend located proximate the articulated joint. In other embodiments, the housing may include a bent housing section, an extension sub section, and a bearing housing section. In yet other embodiments, the housing may include a one piece bent housing section and a bearing housing section.

FIGS. 1-4 illustrate a few of the connecting rod assemblies, useful in downhole motors, according to embodiments described above. Referring initially to FIG. 1, a downhole motor may include a power section (not illustrated), a connecting rod assembly 10, and a drive shaft (not illustrated). The power section may include a stator and a rotor configured to rotate eccentrically when a drilling fluid is passed through the stator. The connecting rod assembly 10 operatively connects the rotor of the power section and the drive shaft of the bearing section.

The connecting rod assembly 10 may include a housing 12 and a connecting rod 14. The housing 10 may have a proximal end 16 and a distal end 18. The proximal end 18 may be connected to the stator of the power section (not illustrated), and the distal end 18 may be connected to the bearing section housing (not illustrated).

The connecting rod 14 may include a flexible rod 20 having an upper pin connection 22 (at the proximal end) and a lower pin connection 24 (at the distal end). The upper pin connection 22 may operatively connect to the rotor while the lower pin connection 24 may operatively connect to a first end 26 of an upper member 28 of an articulating joint 34. A second end 30 of the upper member 28 may terminate at torque transferring components 32 of the articulating joint 34. Torque transferring components 32 may be integral or non-integral with the upper member 28.

As illustrated in FIG. 1, housing 12 may include three sections. The three sections may include a proximal flex housing section 36, a distal bearing housing section 38, and a cross-over housing section 40 therebetween. The bend in the cross-over housing may be located proximate the articulated joint 34.

As also illustrated in FIG. 1, connecting rod 14 may include upset section 42 and an upset section 44 proximate the pin connections 22, 24 to provide added strength to the flexible rod proximate the rigid pin connections 22, 24.

Figure 2:
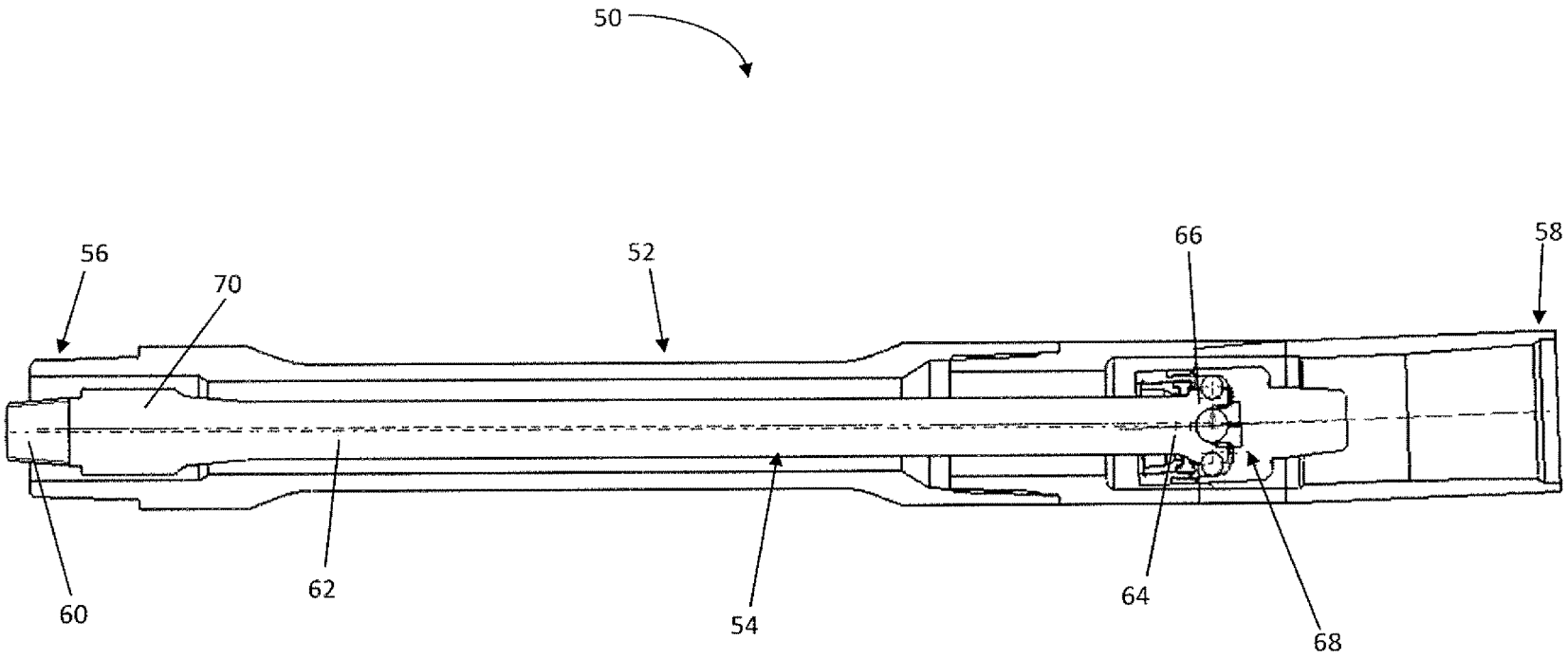
FIG. 2 is a schematic diagram of a connecting rod assembly according to one or more embodiments herein.

Referring now to FIG. 2, a connecting rod assembly according to one or more embodiments herein having a unitary connecting rod is illustrated. A downhole motor incorporating the connecting rod assembly, as illustrated in FIG. 2, may include a power section (not illustrated), a connecting rod assembly 50, and a drive shaft (not illustrated). The power section may include a stator and a rotor configured to rotate eccentrically when a drilling fluid is passed through the stator. The connecting rod assembly 50 operatively connects the rotor of the power section and the drive shaft of the bearing section.

The connecting rod assembly 50 may include a housing 52 and a connecting rod 54. The housing 52 may have a proximal end 56 and a distal end 58. The proximal end 56 may be connected to the stator of the power section (not illustrated). The distal end 58 may be connected to the bearing section housing (not illustrated).

The connecting rod 54 may have an upper pin connection 60 operatively connected to the rotor (at a proximal end), a mid flexible rod 62, and a lower distal end 64 which may terminate at torque transferring components 66 of an articulating joint 68. The torque transferring components 66 may be integral or non-integral with the connecting rod 54.

Similar to the embodiment of FIG. 1, the connecting rod 62 may include upset section 70 proximate the upper pin connection 60 to provide added strength to the flexible rod proximate the rigid upper pin connection 60.

Figure 3:
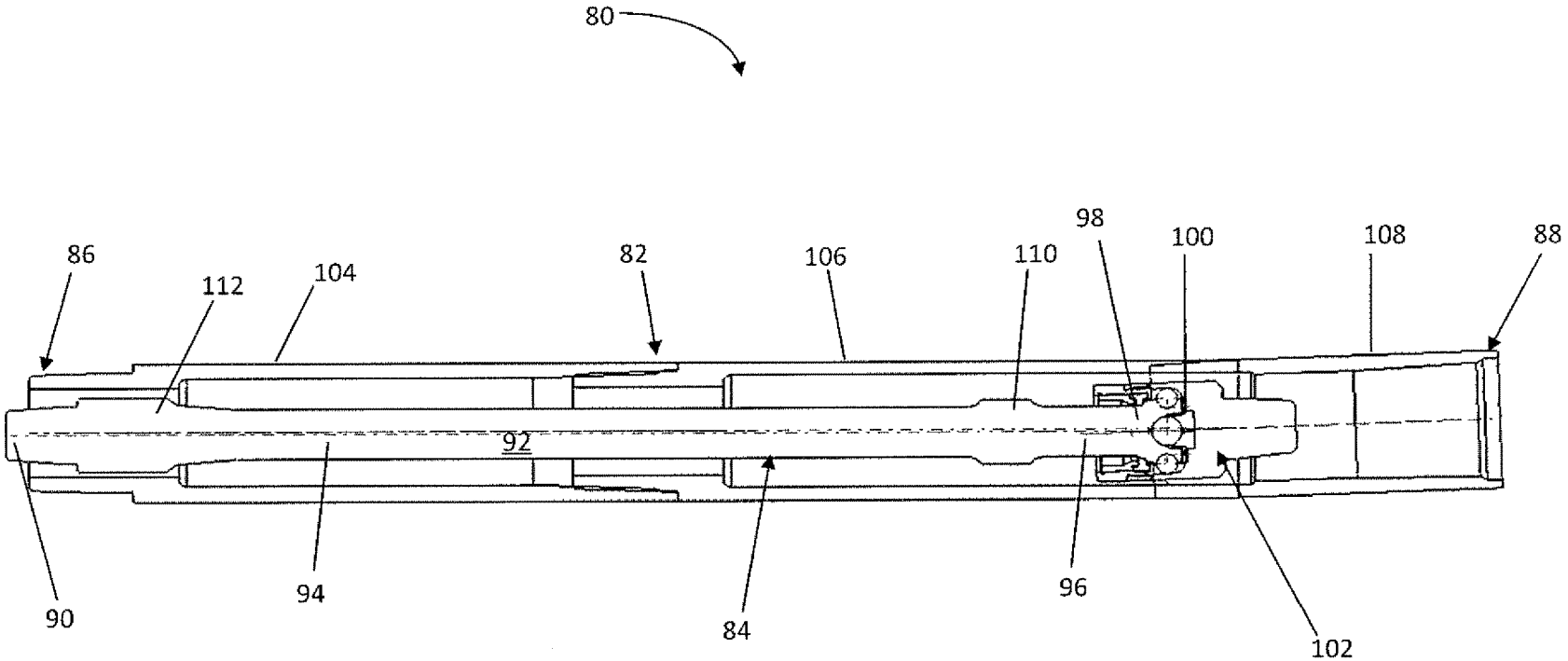
FIG. 3 is a schematic diagram of a connecting rod assembly according to one or more embodiments herein.

Referring now to FIG. 3, a connecting rod assembly according to one or more embodiments herein having a unitary connecting rod formed from different materials is illustrated. A downhole motor incorporating the connecting rod assembly, as illustrated in FIG. 3, may include a power section (not illustrated), a connecting rod assembly 80, and a drive shaft (not illustrated). The power section may include a stator and a rotor configured to rotate eccentrically when a drilling fluid is passed through the stator. The connecting rod assembly 80 operatively connects the rotor of the power section and the drive shaft of the bearing section.

The connecting rod assembly 80 may include a housing 82 and a connecting rod 84. The housing 82 may have a proximal end 86 and a distal end 88. The proximal end 86 may be connected to the stator of the power section (not illustrated). The distal end 88 may be connected to the bearing section housing (not illustrated).

The connecting rod 84 may have an upper pin connection 90 at a proximal end 94 thereof operatively connected to the rotor, a mid flexible rod 92 welded at a distal end thereof to an upper member 96 of an articulating joint 102, and a lower end 98 of the upper member 96 which may terminate at torque transferring components 100 of the articulating joint 102. The torque transferring components 100 may be integral or non-integral with the upper member 96.

As illustrated in FIG. 3, the housing may include a bent housing section 104, an extension sub section 106, and a bearing housing section 108.

The mid flexible rod 92 and upper member 96 of the articulating joint 102 may be formed from two different materials. The flexible rod 92 may be formed using a flexible metal, such as a titanium-based alloy, while the upper member 96 may be formed from a stiffer material, such as a steel. The different materials may be connected via a weld at an upset section 110, the upset section providing additional strength to the weld. The connecting rod 84 may also include an upset section 112 proximate the proximal end 94 thereof to provide added strength to the flexible rod 92 proximate the rigid upper pin connection 90.

Figure 4:
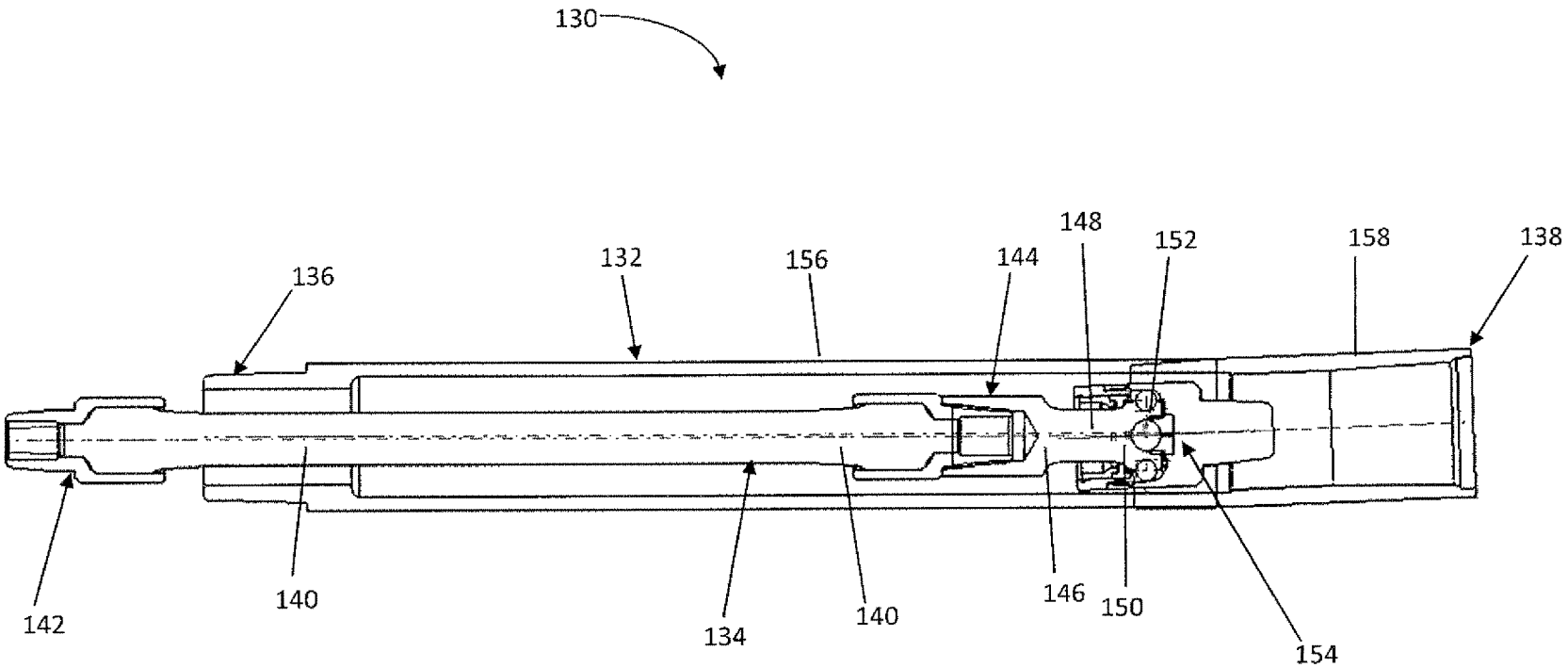
FIG. 4 is a schematic diagram of a connecting rod assembly according to one or more embodiments herein.

Referring now to FIG. 4, a connecting rod assembly according to one or more embodiments herein is illustrated. A downhole motor incorporating the connecting rod assembly, as illustrated in FIG. 4, may include a power section (not illustrated), a connecting rod assembly 130, and a drive shaft (not illustrated). The power section may include a stator and a rotor configured to rotate eccentrically when a drilling fluid is passed through the stator. The connecting rod assembly 130 operatively connects the rotor of the power section and the drive shaft of the bearing section.

The connecting rod assembly 130 may include a housing 132 and a connecting rod 134. The housing 132 may have a proximal end 136 and a distal end 138. The proximal end 136 may be connected to the stator of the power section (not illustrated). The distal end 138 may be connected to the bearing section housing (not illustrated).

The connecting rod 134 may include a flexible rod 140 having an upper rotary shouldered connection 142 and a lower rotary shouldered connection 144. The upper rotary shouldered connection 142 operatively connects to the rotor. The lower rotary shouldered connection 144 operatively connects to a first end 146 of an upper member 148 of an articulating joint 154. A second end 150 of the upper member 148 may terminate at torque transferring components 152 of an articulating joint 154. The torque transferring components 152 may be integral or non-integral with the upper member 148.

As illustrated in FIG. 4, the housing 132 may include a one piece bent housing section 156 and a bearing housing section 158. The housing 132 may be located downhole relative to the upper rotary shouldered connection 142 to connect to a power section having an extended stator. In such an embodiment, the upper rotary connection 142 may be disposed within the stator and the stator may be connected to housing 132 below the upper rotary connection 142.

In other embodiments herein, the downhole motor may include a power section, a connecting rod assembly, and a drive shaft. The power section may include a stator and a rotor configured to rotate eccentrically when a drilling fluid is passed through the stator. The connecting rod assembly operatively connects the rotor of the power section and the drive shaft of the bearing section. The connecting rod assembly may include a housing and a connecting rod disposed within the housing. The housing may include a proximal end and a distal end with the proximal end connected to the stator. The connecting rod may include a flexible rod having an upper pin connection and a lower shrink fit connection. The upper pin connection operatively connects to the rotor. The lower shrink fit connection operatively connects to a first end of an upper member of an articulating joint and a second end of the upper member may terminate at torque transferring components of the articulating joint. The torque transferring components may be integral or non-integral with the upper member. In some embodiments, the flexible shaft of the connecting rod may be formed from a flexible material, which may be shrunk fit to a rotary shouldered connection at the rotor end (proximate end) thereof and shrunk fit to the upper member of the articulating joint at the drive shaft end (distal end) thereof.

As described above with respect to FIGS. 1 to 4, various embodiments of a connecting rod assembly for a progressive cavity type or Moineau type downhole mud motor are disclosed herein. At least some of the embodiments include a flexible rod (i.e., flexible connecting rod) and only one articulated joint (e.g., a constant velocity joint or universal joint) positioned at or near a downhole end portion of the flexible rod. The flexible rod may have an upset section on each end thereof. Upper and lower connections may connect the upset sections of the flexible rod to the rotor and to the drive shaft (via the articulating joint). These connections may be integral or non-integral to the flexible rod. In one or more embodiments, the flexible rod may be part of the rotor at an upper end thereof and have an upset at the lower end thereof. The upset may be used to weld a lower connection thereto, e.g., a portion of the articulating joint such as the upper member of the articulating joint. The upper and lower connections (e.g., the upper member of the articulating joint) can be made of a different material from the flexible rod. In one or more other embodiments, the upper connection may be a rotary shoulder connection that attaches to the lower end of the rotor. The lower end of the articulated joint connects to the drive shaft. The cross-over housing bend is placed at the articulated joint just above the bearing housing so that the bend has no effect on the side load or bending moment of the flexible rod above. The connecting rod is flexible in bending so that side loads between the upper and lower ends of the articulated joint and lower end of the rotor and stator are small compared to their load capacities. The rod is also torsionally flexible so that any dynamic torque loads in the motor drive train from sudden changes in rotational speed at the drill bit are reduced. This reduces the peak torques seen by the connecting rod and also the connections between the connecting rod and the rotor and drive shaft.

In the area proximate the lower end rotor connection, the diameter that can be used for a connection or joint is reduced by the rotor sweep through the gyration from the eccentricity between the rotor and stator and the inside diameter of the stator tube or adjoining housing. In the embodiments disclosed herein, the articulated joint at the lower end of the rotor is eliminated. The flexible rod is rigidly attached to the rotor with no moving parts and only carries the bending moment created from the side load at the lower end of the rotor due to the rotor offset with the drive shaft. A rotary shouldered connection may more efficiently use the reduced space to carry the torque, but may still have limited torque capacity.

The connecting rod of one or more embodiments disclosed herein has only the one rigid connection and bending moment at the rotor. Consequently, for the same torque capacity and side load, the one or more connecting rod embodiments disclosed herein need less length than a double bend flexible rod with the rigid connections and bending moments at both ends (i.e., at the rotor and the drive shaft). This length change for the same bending moment can be calculated. For simplicity, the most conservative improvements are assumed with no thrust loads on the connecting rods. For the same bending moment, the length of the flexible section of the connecting rod of one or more embodiments disclosed herein is $1/(\sqrt{2})$ times or about 71% of the flexible section of the double bend flexible rod having a motor cross-over housing with no bend. At this length, the side load is about 80% of the side load for the double bend flexible rod. As described previously, the cross-over housing bend may be best placed at the articulated joint just above the bearing housing so that the bend has no affect on the side load or bending moment of one or more connecting rod embodiments disclosed herein. This places the housing bend at an optimal practical position on the motor for steerability i.e., a minimum amount of bend needed to steer. With the bend placed at the articulated joint, there is no change in the side load of the connecting rod (of one or more embodiments disclosed herein) at the articulated joint with any change of bend angle of the bent housing. Also, the side loads at the lower end of the rotor against the stator are relatively consistent in all directions regardless of the amount of bend in the cross-over housing. For example, a multi-lobe power section motor may include ⅘ lobes, 0.355 inches of eccentricity and 2 degrees of bend at the bend housing with a double bend flexible rod length of 70 inches. For minimum double bend flexible rod length, the bend must be in the middle or 35 inches further away from the bit. Even allowing for this, for the same maximum moment as the connecting rod (of one or more embodiments disclosed herein), the length is 48% of the double bend flexible rod and the side load is 68% of the maximum side load. Thus, the connecting rod (of one or more embodiments disclosed herein) may have bent housings from 0.25 degrees to 5 degrees.

The side loads are also in the direction to move the rotor tip into the stator tip. When the connecting rod of one or more embodiments disclosed herein and the double bend flexible rod are compared without a bent housing and with increased thrust loads applied (e.g., in the event of a motor stall), the side load moves toward loading the root of the rotor against the root of the stator and away from the tips (but still at a reduced amount compared with an articulated joint near the rotor). This reduces the amount of movement of the rotor lobe tip off of the stator lobe tip so that the stator rubber is more likely to have squeeze and a high pressure drop and torque capacity for the last motor stages. When the connecting rod of one or more embodiments disclosed herein and the double bend flexible rod are compared with a bent housing with the bend at the bottom connection, the connecting rod has no change in the bending moment at the rotor. However, the double bend flexible rod has an additional moment towards the direction of the bent housing bend due to the bending moment at the lower connection. Due to this additional moment, the rotor tip is pulled into the stator lobe tip in the direction of bent housing bend and away from the stator tip in the opposite direction of the bent housing bend. Thus, on one side, the elastomer is squeezed more, and on the opposite side, the elastomer is squeezed less, such that there is uneven pressure drop and torque capacity from one side to the other of the last motor stages.

The motor bend being relatively close to the bit makes the motor below the bend stiff, such that as the motor deflects to conform to the hole, the bit is more likely to keep its angle with respect to the center of the motor, the BHA above, and the borehole. The top end of the connecting rod (of one or more embodiments disclosed herein) having a relatively small diameter may allow for the top of the bent cross-over housing to be undersized and act as flex housing. The flex housing or flex housing assembly may have an outside diameter less than 90% of the motor housing outer diameter and still have the same section modulus with its reduced inner diameter so that bending stresses remain the same. By positioning the flex housing a relatively long distance above the motor bend, the motor below the bend is made even more relatively stiff with respect to the bit and even more likely to keep its angle with respect to the center of the motor, BHA above, and the borehole. This may also serve to reduce bending moments in the motor housings and allow for larger bent housing angles.

As shown in FIG. 1, the flexible rod 20 may use pin connections 22, 24 on both ends to make up with the rotor and the articulating joint 34 (e.g., a CV joint). As shown in FIG. 2, the flexible rod 54 may be made from one piece so that the design complexity of the added stiff length of a connection at each end having a different material is eliminated. Since the same material can be used as for the articulated joint 68, the material expense is reduced with the complexity of only one articulated joint 68. The flexible rod 54 may be part of the upper end of the articulating joint 68, or as shown in FIG. 3, the flexible rod 84 may be welded to the articulating joint 102 (e.g., an upper member thereof) using an upset 110 for weld joint strength. As shown in FIG. 4, the flexible rod 134 may be made with a more flexible material, such as titanium-based alloys, and attached to joints at each end, in this case, e.g., joined to the upper end of the articulating joint 154 by a rotary shouldered connection 144. There are other combinations of end connections that may be used according to embodiments disclosed herein.

Although only a few example embodiments have been described in detail above, those skilled in the art will readily appreciate that many modifications are possible in the example embodiments without materially departing from the disclosure. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means plus function treatment for any limitations of any of the claims herein, except for those in which the claim expressly uses the words 'means for' together with an associated function.

What is claimed is:

1. A downhole motor, comprising:

a connecting rod assembly configured to operatively connect a rotor and a drive shaft, the connecting rod assembly including:

a housing having a proximal end and a distal end, the proximal end configured to connect to a stator;

an articulating joint configured to be operatively connected to the drive shaft; and a connecting rod having:

a proximal end including a rigid connection operatively connected to the rotor, the rigid connection including a pin connection;

a distal end operatively connecting to the articulating joint;

a mid flexible rod section disposed between the proximal end and the distal end of the connecting rod, wherein the proximal end, mid flexible rod section, and distal end of the connecting rod are unitary; and an upset section intermediate the pin connection and the mid flexible rod section.

2. The downhole motor of claim 1, wherein the rigid connection includes at least one of a threaded connection or a rotary shouldered connection.

3. The downhole motor of claim 1, wherein the articulating joint is a constant velocity joint (CV joint) or a universal joint (U-joint).

4. The downhole motor of claim 1, wherein two or more of the proximal end, the mid flexible rod section, and the distal end are made from different materials.

5. The downhole motor of claim 1, wherein the mid flexible rod section includes a titanium-based alloy.

6. The downhole motor of claim 1, wherein the housing comprises a proximal flex housing section, a distal bearing housing section, and a cross-over housing section therebetween.

7. The downhole motor of claim 1, wherein the housing comprises a bent housing section, an extension sub section, and a bearing housing section.

8. The downhole motor of claim 1, wherein the articulating joint comprises an upper member connected to the connecting rod and comprising a first material, the mid flexible rod section comprising a second material, the second material having a greater flexibility than the first material.

9. The downhole motor of claim 8, wherein the connecting rod is connected to the upper member at the upset section.

10. The downhole motor of claim 1, wherein the connecting rod comprises a second upset section that is proximal to the rigid connection with the rotor.

11. The downhole motor of claim 1, wherein the rigid connection is a threaded connection or a second pin connection.

12. A drill motor connecting rod assembly, comprising:

a housing having a proximal end and a distal end;

an articulating joint; and a connecting rod disposed within the housing, the connecting rod including:

a proximal end terminating at a rigid connection, the rigid connection including a pin connection;

a distal end operatively connecting to the articulating joint; and a mid flexible rod section connected between the proximal and distal ends of the connecting rod; and an upset section intermediate the pin connection and the mid flexible rod section, wherein the proximal end, mid flexible rod section, and distal end of the connecting rod are unitary.

13. The drill motor connecting rod assembly of claim 12, wherein the rigid connection is at least one of a threaded connection or a rotary shouldered connection.

14. The drill motor connecting rod assembly of claim 12, wherein the articulating joint is a constant velocity joint (CV joint) or a universal joint (U-joint).

15. The drill motor connecting rod assembly of claim 12, wherein the two or more of the proximal end, the mid flexible rod section, and the distal end are made from different materials.

16. The drill motor connecting rod assembly of claim 12, wherein the mid flexible rod section includes a titanium based alloy.

17. The drill motor connecting rod assembly of claim 12, wherein the housing comprises a proximal flex housing section, a distal bearing housing section, and a crossover housing section therebetween.

18. The drill motor connecting rod assembly of claim 12, wherein the housing comprises a bent housing section, an extension sub section, and a bearing housing section.

19. The drill motor connecting rod assembly of claim 12, wherein the housing comprises a one piece bent housing section and a bearing housing section.

20. A drill motor connecting rod assembly, comprising:

a housing having a proximal end and a distal end, the proximal end configured to be connected to a stator;

an articulating joint comprising an upper member; and a connecting rod disposed within the housing, the connecting rod including:

a flexible rod having an upper pin connection and a lower pin connection;

the lower pin connection operatively connected to a first end of the upper member of the articulating joint, a second end of the upper member cooperating with torque transferring components of the articulating joint;

the upper pin connection being configured to be rigidly connected to a rotor; and an upset section intermediate one or more of the upper pin connection or the lower pin connection and the flexible rod, wherein the proximal end, flexible rod, and distal end of the connecting rod are unitary.

21. The drill motor connecting rod assembly of claim 20, wherein the flexible rod includes a titanium-based alloy.

* * * * *